US007461908B1

(12) United States Patent
Heiligenthal et al.

(10) Patent No.: US 7,461,908 B1
(45) Date of Patent: Dec. 9, 2008

(54) CABINET LOCKING SYSTEM

(75) Inventors: Charles H. Heiligenthal, Kenosha, WI (US); David A. Doerflinger, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 70 days.

(21) Appl. No.: 11/072,729

(22) Filed: Mar. 4, 2005

Related U.S. Application Data

(60) Provisional application No. 60/550,649, filed on Mar. 5, 2004.

(51) Int. Cl.
*E05B 65/46* (2006.01)

(52) U.S. Cl. ..... 312/221; 312/217

(58) Field of Classification Search ..... 312/216, 312/217, 218, 221, 330.1, 333, 334.1, 334.7, 312/220, 334.6
See application file for complete search history.

(56) References Cited

U.S. PATENT DOCUMENTS

| | | | | | |
|---|---|---|---|---|---|
| 486,455 | A | * | 11/1892 | Feige | 312/217 |
| 497,406 | A | * | 5/1893 | Du Bois et al. | 312/221 |
| 505,799 | A | | 9/1893 | Brown | |
| 858,982 | A | * | 7/1907 | Heinitz | 235/22 |
| 950,813 | A | * | 3/1910 | Bodenstein | 312/222 |
| 1,157,032 | A | * | 10/1915 | Ohnstrand | 312/221 |
| 1,552,511 | A | * | 9/1925 | Secoy | 312/221 |
| 1,909,848 | A | * | 5/1933 | Rand | 312/218 |
| 1,951,628 | A | | 3/1934 | Prost | |
| 2,333,511 | A | * | 11/1943 | Bates et al. | 109/53 |
| 2,559,579 | A | | 7/1951 | Abrahamson | |
| 2,597,684 | A | * | 5/1952 | Stringe | 312/333 |
| 2,966,384 | A | | 12/1960 | Bergman | |
| 3,259,444 | A | * | 7/1966 | Friend | 312/221 |
| 3,318,646 | A | * | 5/1967 | Ibel | 312/218 |
| 3,791,708 | A | * | 2/1974 | Signore | 312/221 |
| 4,168,103 | A | | 9/1979 | Hagen | |
| 4,394,056 | A | * | 7/1983 | Janke | 312/216 |
| 4,425,013 | A | * | 1/1984 | Killen | 312/216 |
| 4,452,498 | A | * | 6/1984 | Wood et al. | 312/216 |
| 4,478,466 | A | * | 10/1984 | Clark et al. | 312/215 |
| 4,721,347 | A | | 1/1988 | Kritselis | |
| 4,770,476 | A | | 9/1988 | Lakso | |
| 5,435,640 | A | | 7/1995 | Holcomb | |
| 5,456,531 | A | | 10/1995 | Beals | |
| 6,109,709 | A | | 8/2000 | Holcomb et al. | |
| 6,347,848 | B1 | * | 2/2002 | Cho | 312/219 |
| 6,742,854 | B2 | * | 6/2004 | Chen | 312/217 |

* cited by examiner

*Primary Examiner*—James O Hansen
(74) *Attorney, Agent, or Firm*—Seyfarth Shaw LLP

(57) ABSTRACT

A cabinet locking system having a drawer having a side panel disposed between a front panel and a back panel and a first corner formed by the intersection of the side and back panels. A lock bar is mounted within the cabinet adjacent a first corner when the drawer is in a closed position and the lock bar includes an aperture. A slide is provided having an integrally formed lock tab and the slide is mounted to the side panel of the drawer so that the lock tab protrudes beyond the back panel. In the closed position, the lock tab is received by the aperture so that the drawer may be locked within the cabinet.

18 Claims, 2 Drawing Sheets

CABINET LOCKING SYSTEM

CROSS REFERENCE TO RELATED APPLICATION

The present application claims the benefit of the filing date of U.S. Provisional Application No. 60/550,649, filed Mar. 5, 2004.

The present application pertains to a cabinet locking system and a method of locking and assembling a cabinet and, in particular, a drawer slide that has a lock tab that is received by a movable lock bar for locking a drawer within the cabinet.

BACKGROUND

Locking mechanisms for drawers have been known that simultaneously lock multiple drawers of a cabinet. On the face of the cabinet is a keyhole which is coupled to a locking mechanism. Upon turning of a key in the keyhole, the mechanism will lock or unlock the drawers within the cabinet. Many types of locking systems are known having various arrangements and constructions of the cabinet and locking mechanism. For example, a drawer including a back panel has a tab that protrudes perpendicularly from a center point of the back panel. The tab is received by a locking assembly structure mounted to the inner wall of the cabinet. The locking assembly member is coupled to the locking mechanism so that it is actuated upon locking or unlocking of the cabinet. Actuation of the locking assembly structure causes it to clamp down or slide onto the tab protruding from the back of the drawer in order to lock the drawer within the cabinet.

Such assemblies require multiple components to be assembled to the drawer and cabinet. In addition to the tab itself, there is an attachment member that retains the tab to the back panel of the drawer. As well, the drawer requires holes to be stamped therein for the tab to protrude through. As well, the locking assembly structure requires multiple components including a pair of metal strips forming a U-shaped channel. In addition, the locking assembly structure is formed of a rectangular shaped member that is formed from multiple metal pieces. The locking assembly structure and the channel are mounted to the inner wall of the cabinet using fasteners or via bonding means such as welding. Therefore there are multiple components and many assembly steps required for such a locking mechanism to be manufactured. Such an assembly and manufacturing process are both time consuming and costly. The present application provides for a locking assembly which does not have such disadvantages.

SUMMARY

An embodiment of the cabinet locking system comprises a drawer having a side panel disposed between a front panel and a back panel and a first corner formed by the intersection of the side and back panels, a lock bar mounted within the cabinet adjacent the first corner when the drawer is in a closed position, the lock bar including an aperture, and a slide having an integrally formed lock tab and the slide mounted to the side panel of the drawer so that the lock tab protrudes beyond the back panel and in the closed position the lock tab is received by the aperture so that the drawer may be locked within the cabinet. In an embodiment, the lock tab may be hook shaped and includes a finger that engages an edge of the aperture of the lock bar. In an embodiment, the lock bar may be movable between locked and unlocked conditions. In an embodiment, the lock bar may be oriented vertically within the cabinet and may be slidable up and down between locked and unlocked conditions.

In an embodiment, the cabinet includes at least two drawers that are arranged side by side slidable parallel to a first axis. In an embodiment, the lock bar may be oriented parallel to a second axis, transverse to the first axis. In an embodiment, the lock bar includes multiple apertures for receiving lock tabs extending from multiple drawers. In an embodiment, the cabinet includes a channel for receiving the lock bar. In an embodiment, the channel may be formed by a false side wall formed generally in a U-shape. In an embodiment, the false side wall includes a flange protruding from a back wall and a tab protruding from the flange forming a generally U-shaped pocket for receiving an edge of the lock bar. In an embodiment, the channel may be formed of one piece including a false side wall. In an embodiment, the false side wall may be parallel to the side of the drawer. In an embodiment, the slide is part of a slide assembly which includes a track for slidably mounting the drawer within the cabinet. In an embodiment, the drawer includes a pair of slides respectively mounted on opposed side panels. In an embodiment, the lock bar may be connected to a locking mechanism actuatable from a face of the cabinet adjacent the front panel. In an embodiment, the cabinet has a flexible construction so that the lock tab may be inserted into the aperture whether the lock bar is in either a locked or unlocked condition.

An embodiment provides for a method of locking a cabinet comprising the steps of providing a slide on a drawer, the slide having an integral lock tab protruding from a back of the drawer, sliding a drawer into a closed position within a cabinet, orienting the lock tab within an aperture of a lock bar mounted within the cabinet and actuating the lock bar so that it engages the lock tab in order to lock the drawer within the cabinet. In an embodiment, the method further comprises the step of actuating a locking mechanism linked to the lock bar in order to move the lock bar between a locked and unlocked condition. In an embodiment, the method further comprises the step of sliding the lock bar through a channel formed by a false side panel.

An embodiment further provides a method of assembling a cabinet comprising the steps of forming a cabinet housing having a side wall, a false side wall and a back wall, forming the false side wall so that an edge attached to the back wall forms a generally L-shaped, one-piece channel, slidably mounting a lock bar within the channel, mounting the drawer in the cabinet on a slide assembly including a first slide mounted to a side of the drawer and having an integral lock tab and engaging the lock tab with the lock bar when the drawer is in a closed position in order to lock the drawer within the cabinet. In an embodiment, the drawer may include a side panel disposed between a front panel and a back panel and a first corner formed by the intersection of the side panel and back panel. In an embodiment, the lock bar may be mounted within the cabinet adjacent the first corner when the drawer may be in a closed position. In an embodiment, the method may further comprise mounting a second slide to the drawer on a side opposite the first slide, the second slide including a second integral lock tab protruding from a second corner of the drawer. In an embodiment, there are no additional lock tabs attached to the drawer. In an embodiment, there are no lock tabs are mounted on the back panel, other than at the first and second corners.

A further embodiment provides for a cabinet comprising a back wall disposed between and intersecting first and second side walls to form a first outer corner, a false side disposed parallel the first side wall, a generally U-shaped one-piece channel formed at an edge of the false side, the channel including a rear portion and a flange protruding therefrom generally perpendicular to the rear portion, the rear portion secured to the back wall of the cabinet adjacent the first outer corner and a lock bar slidably mounted within the channel. In an embodiment, the flange of the channel may include a tab forming a groove for receiving an edge of the lock bar.

In an embodiment, the cabinet further may include a drawer mounted therein and the drawer including a slide mounted to a side to slidably mount the drawer to a first side wall. In an embodiment, the slide may include an integrally formed lock tab protruding from the drawer and received by an aperture of the lock bar in order to lock the drawer within the cabinet. In an embodiment, the cabinet may include a locking mechanism in order to actuate the lock bar. In an embodiment, the slide may include a track for mounting to an attachment member of the first side wall. In an embodiment, the false side includes an attachment member having an abutment end for abutting against the lock bar and retaining it within the channel. In an embodiment, an intermediate member is mounted to the attachment member and a drawer slide mounted to the intermediate member so that a drawer may be slidable in and out of the cabinet.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
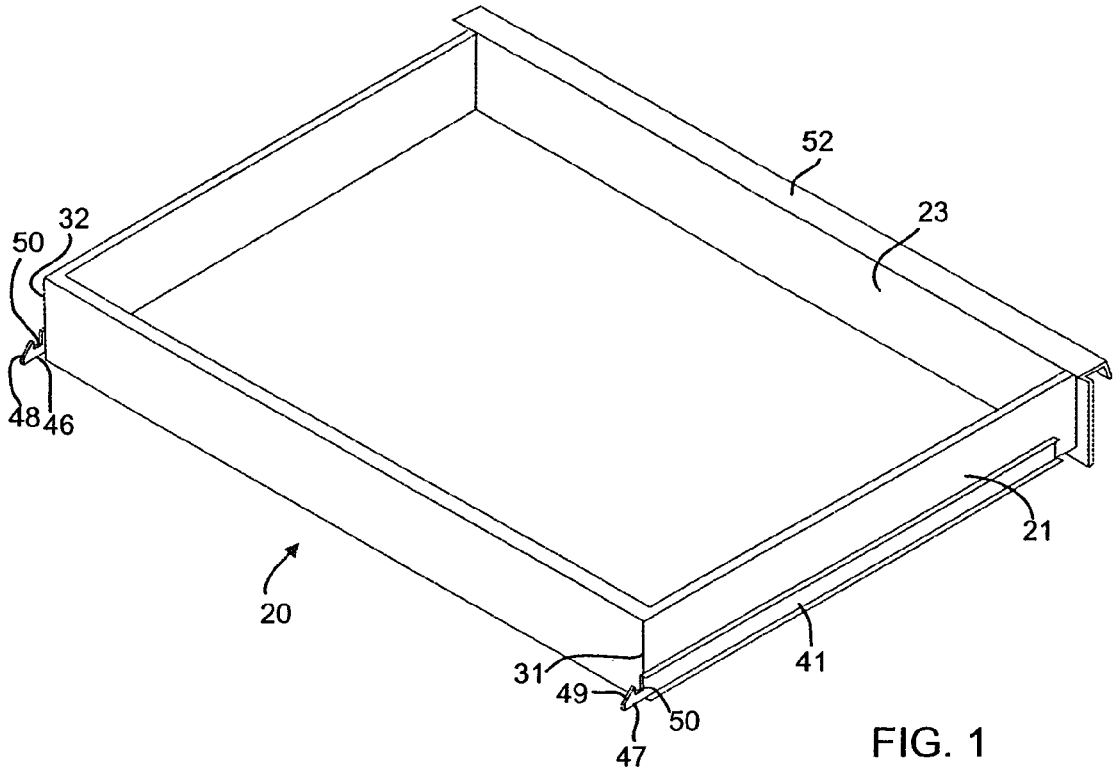
FIG. 1 is a rear perspective view of a drawer of the cabinet locking system.
Figure 2:
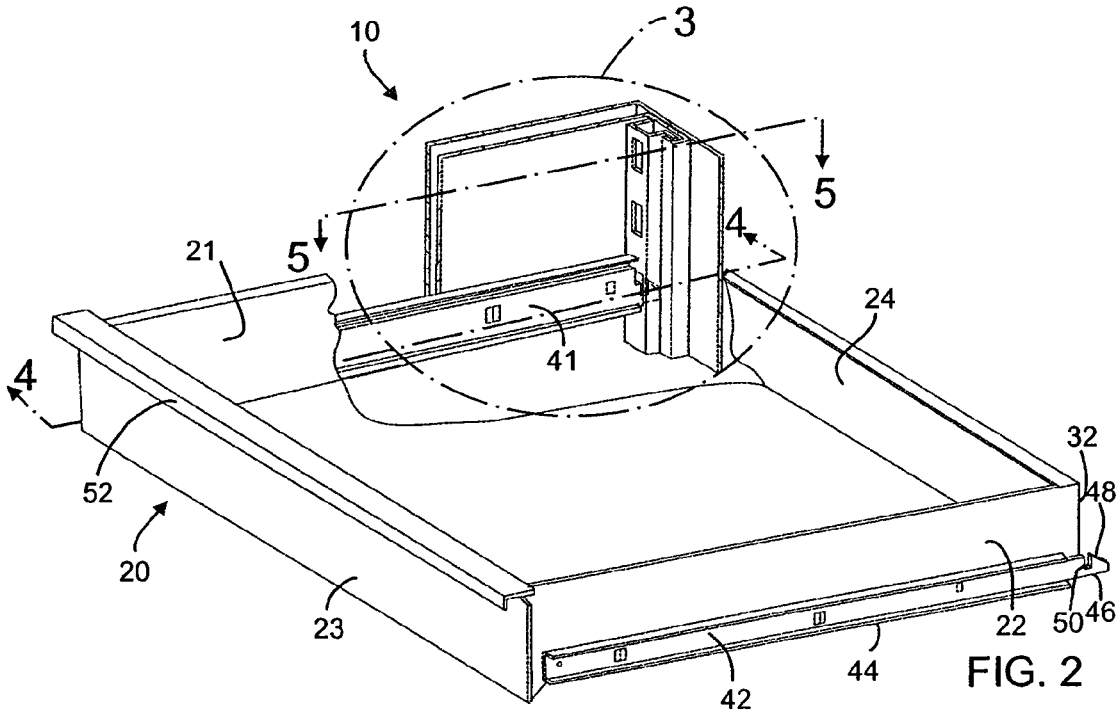
FIG. 2 is a front perspective view of the drawer of FIG. 1 disposed in a cabinet having a cut-away portion identified by circle 3.

An embodiment of a cabinet locking mechanism is described with respect to FIGS. 1-5. A cabinet 10 is provided having a drawer 20. The drawer includes a first side panel 21, a second side panel 22, a front panel 23 and a back panel 24. FIG. 1 depicts the drawer 20 viewing it from the back panel 24 and FIG. 2 depicts the drawer 20 viewing it from the front panel 23. The first side panel 21 and back panel 24 intersect at a first corner 31 and the second side panel 22 and the back panel 24 intersect at a second corner 32. Each side panel 21, 22 has a slide 41, 42 mounted thereto. In an embodiment each slide 41, 42 is formed of an elongated metal bar having a track 44 formed therein. The slide 41, 42 may be attached to the side panel 21, 22 by any known means such as fasteners, welding, adhesive or connectors. Each slide 41, 42 includes a lock tab 46, 47. In an embodiment the lock tab 46, 47 is integrally formed with the slide 41, 42 and it includes a hook shaped finger 48, 49, respectively, having a tapered end and a notch 50. The drawer 20 may also include a handle 52 formed in an "L" shape along the top of the front panel 23.

The drawer 20 is mounted within the cabinet 10, as shown in FIGS. 2-5. FIG. 2 depicts portions of the first side panel 21, first corner 31, and the back panel 24 removed so that the first slide 41 may be viewed engaging the cabinet 10

The cabinet 10 includes a first side wall 61 and a back wall 63. A false side wall 65 is disposed parallel to the first side wall 61 of the cabinet 10. The false side wall 65 includes an attachment member 67 to which the slide 41 is mounted. Mounting methods that are well known in the art may be used to mount the slide 41, 42 to the false side wall 65. For example, ball bearings may be provided within an intermediate member 68 of the slide 41 so that it slides freely within the attachment member 67 (see FIG. 5). The attachment member 67 includes an abutment end 67*a*.

Figures 3, 4, 5:
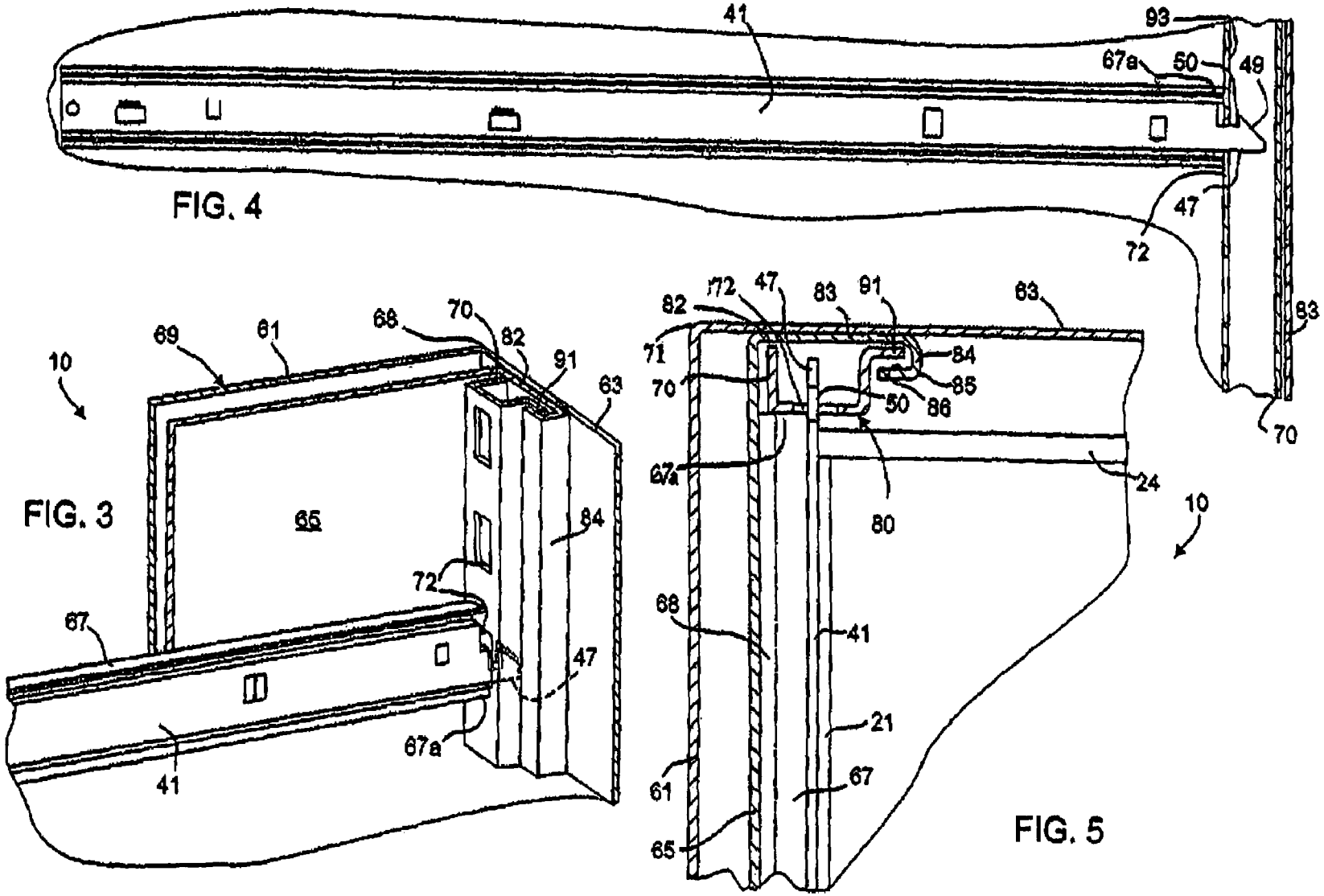
FIG. 3 is an enlarged fragmentary view of cut-away portion 3 of FIG. 2 depicting the cabinet locking system.
FIG. 4 is an enlarged, fragmentary sectional view taken at line 4-4 in FIG. 2.
FIG. 5 is an enlarged, fragmentary sectional view taken at line 5-5 in FIG. 2.

As shown in FIG. 3, the back wall 63 and first wall 61 form an outer corner 71. A cabinet housing 69 is formed by the back wall 63, first wall 61, second wall and front wall (not shown). The cabinet 10 includes a lock bar 70 mounted along the back wall 63. The lock bar 70 is mounted within the housing 69 at the back wall 63 adjacent the outer corner 71. The lock bar 70 includes apertures 72 formed therein for receiving the lock tab 47.

A channel 80 is formed by the false side wall 65 providing an L-shaped section 82 having a rear portion 83 and an edge 84. The edge 84 includes a U-shaped flange 85 forming a groove or pocket 86. The pocket 86 receives tab 91 of the lock bar 70. In an alternate embodiment, the edge 84 protrudes perpendicular from the back wall 63 and includes a tab protruding therefrom to form a groove or pocket 86. In an embodiment, the tab 91 rides in the pocket 86 when the lock bar 70 is slid up and down upon actuation of the locking mechanism. In an embodiment, at the upper end (not shown) of the lock bar 70 there is a mechanism, for example, a rod, which drives the lock bar 70 up and down when the rod is rotated upon actuation by a key in a keyhole (not shown). Other well-known means of actuating the lock bar 70 may also be incorporated.

In an embodiment, a lid and a bottom (not shown) of the cabinet 10 enclose the channel 80 so that the lock bar 70 is trapped therein. In an embodiment, the bottom may be attached to the cabinet housing 69 via screws or other fasteners. In an embodiment, bottom windows (not shown) may be provided on the bottom. The lock bar 70 may be easily removed for repair purposes from the cabinet housing 69 by removing the bottom or bottom windows. By withdrawing the drawers from the closed position, the lock tabs 46, 47 are removed from the aperture 72 of the lock bar 70 and then the lock bar 70 may be easily slid downward and out of the channel 80 and the cabinet 10 to undergo repair or service of the lock bar and cabinet 10.*e* viewed engaging the cabinet 10.

Assembly of the cabinet 10 is also greatly simplified by the present construction. The first side wall 61 and a second side wall are attached to the back wall 63. In an embodiment, adhesives or fasteners may be used. The false side wall 65 is then mounted within the housing 69 so that the rear portion 83 is attached to the back wall 63. As the false side 65 includes as one piece; this whole assembly may be quickly and easily mounted within the housing 69 in order to provide the channel 80. The locking mechanism (not shown) is then installed within the cabinet 10. The lock bar 70 is then installed within the channel 80 so that the tab 91 is inserted in pocket 86 and the rest of the lock bar 70 is pivoted into position so that it is flush against the back of the channel 80. The attachment member 67 is then mounted to the false side wall 65 so that the abutment end 67*a* is abutting the outer face of the lock bar 70. This arrangement allows the attachment member 67 to retain and constrain the lock bar 70 within the channel 80. The drawers 20 are then mounted so that the slides 41, 42 engage the attachment member 67 and intermediate member 68 mounted on the inner walls of the false side wall 65.

The locking procedure of the present construction is also simplified. Upon sliding of the drawer into the cabinet 10, the lock tabs 46, 47 are received by an aperture 72 of the lock bar 70. The finger 48 of the lock tab 47 is received within the aperture 72. As shown in FIG. 3, the lock bar 70 is in its unlocked condition so that the lock tab 47 may be inserted past the aperture opening 72 without abutting any of the edges of the aperture 72. Upon complete closing of the drawer 20 with in the cabinet housing 69, the locking mechanism may be actuated in order to move the lock bar 70 downward to engage the lock tab 47. As shown in FIG. 4, the lock bar 70 is in its locked condition so that the aperture 72 is moved downward so that its upper edge 93 engages the notch 50 of the lock tab 47. The finger 49 of the lock tab is adjacent to the upper edge 93 of the aperture 72. As well, the lock bar 70 is constrained from being pulled out of the channel 80 due to the abutment end 67*a* of the attachment member 67 butting up against the face of the lock bar 70 (as shown in FIG. 4). In the locked condition, the slide 41 cannot be moved outward away from the lock bar 70 because the finger 49 abuts against the edge 93 and restricts the lock tab 47 from withdrawing from the aperture 72. The slide 41 is attached to the drawer 20 so that locking of the slide 41, locks the drawer 20.

The shape of the lock tab 47, having a tapered end forming the finger 49 allows for "slam-locking." When the drawer and slide 41 are in an open position, extended from the cabinet (not shown in FIG. 5); locking of the drawer 10 may still occur while the lock bar 70 remains in the locked condition. By forcibly pushing the drawer 10 closed and slamming the lock tab 47 against the lock bar 70, the cabinet is constructed in an embodiment in such a way that the lock tab 47 may force its way through the aperture 72 into a locked condition. In an embodiment, the lock tab 47 may be formed of a metal which has some resiliency so that the finger 49 has a small degree of flexibility and its tapered angle allows it to compress slightly and slide past the edge 93 of the aperture 72 of the lock bar 70. In an embodiment, the lock bar 70 also may be mounted within the channel 80 of the cabinet 10 so that there is a small degree of play, or vertical movement allowed by the bar 70. Thus, upon forcibly abutting the lock tab 47 against the lock bar 70 the slanted surface of the finger 79 will abut against the edge 93 and force the bar 70 upward (a few millimeters) so that the lock tab 47 may be inserted within the aperture 72. After the finger 49 passes the edge 93, the lock bar will fall back downward so that the edge 93 is received within the notch 50 and lock the slide 41 and drawer 10 within the cabinet housing 69.

It is to be understood that while the figures and description above are with respect to a single drawer 20, in an embodiment multiple drawers are mounted within the cabinet 10 and are received and have slides that have lock tabs that are received by the multiple apertures 72 formed in the lock bar 70. Likewise, although a single lock bar is shown adjacent the first outer corner 68 of the cabinet housing 69, it is to be understood that, in any embodiment, another lock bar 70 is mounted in the opposite corner of the cabinet housing 69 in order to receive the lock tab 46 of the slide 42 depicted in FIG. 2.

In the drawing figures, the lock bar 70 is depicted in a vertical orientation. However, in an embodiment the lock bar 70 may also have a horizontal orientation. For example, if the drawers are oriented so that they are long and narrow in a vertical direction and are aligned side by side along a horizontal axis, the lock bar could also be oriented along a horizontal axis. The drawers are slidable along a first axis and the lock bar 70 is oriented parallel to a second axis. Thus, in an embodiment, the first axis is transverse to the second axis. Therefore, it may be understood from the present construction that a cabinet having a locking mechanism may be quickly and easily assembled and manufactured due to the limited number of components for the assemblies.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A cabinet locking system comprising:

a drawer having a side panel disposed between a front panel and a back panel and a first corner formed by the intersection of the side and back panels;

a cabinet including a first side wall and a false side wall disposed parallel to the first side wall and adjacent to the side panel of the drawer;

a lock bar mounted within the cabinet adjacent the first corner of the drawer when the drawer is in a closed position, the lock bar including a main body having an aperture and a tab extending from the main body;

a channel for receiving the lock bar, the channel formed by the false side wall generally in an L-shape having an elongated portion and a rear portion;

a U-shaped flange mounted to the cabinet for receiving the tab of the lock bar and surrounding the tab on at least two sides in order to guide the lock bar to slide within the cabinet, the U-shaped flange located inwardly of the elongated portion; and a slide having an integrally formed lock tab and the slide mounted to the side panel of the drawer so that the lock tab protrudes beyond the back panel and in the closed position the lock tab is received by the aperture so that the drawer may be locked within the cabinet.

2. The cabinet locking system of claim 1 wherein the lock tab is hook shaped and includes a finger that engages an edge of the aperture of the lock bar.

3. The cabinet locking system of claim 1 wherein the lock bar is movable between locked and unlocked conditions.

4. The cabinet looking system of claim 1 wherein the lock bar is oriented vertically within the cabinet and is slidable up and down between locked and unlocked conditions.

5. The cabinet locking system of claim 1 wherein the cabinet includes at least two drawers that are arranged side by side and are slidable parallel to a first axis.

6. The cabinet locking system of claim 5 wherein the lock bar is oriented parallel to a second axis and the second axis is transverse to the first axis.

7. The cabinet locking system of claim 1 wherein the lock bar includes multiple apertures for receiving lock tabs extending from multiple drawers.

8. The cabinet locking system of claim 1 wherein the slide is a portion of a slide assembly for slidably mounting the drawer within the cabinet.

9. The cabinet locking system of claim 1 wherein the drawer includes two side panels and a pair of slides respectively mounted on the side panels.

10. The cabinet locking system of claim 1 wherein the lock bar is connected to a locking mechanism actuatable from a face of the cabinet adjacent the front panel.

11. The cabinet locking system of claim 1 wherein the cabinet has a flexible construction so that the lock tab may be inserted into the aperture whether the lock bar is in either a locked or unlocked condition.

12. The cabinet locking system of claim 1 wherein the false side wall includes the rear portion and a flange protruding from the rear portion and the tab protruding from the flange forming a generally U-shaped pocket for receiving the tab of the lock bar.

13. The cabinet locking system of claim 1 wherein the channel is formed of one piece including a false side wall.

14. The cabinet locking system of claim 1 wherein the false side wall is parallel to the side panel of the drawer.

15. A cabinet comprising:

a back wall disposed between and intersecting first and second side walls to form a first outer corner;

a false side wall disposed parallel the first side wall;

a drawer mounted to the false side wall;

a generally L-shaped channel formed with the false side wall at an edge of the false side wall, the channel including an elongated portion and a rear portion and a U-shaped flange being located inwardly of the elongated portion and having an edge protruding therefrom generally perpendicular to the rear portion, the rear portion secured to the back wall of the cabinet adjacent the first outer corner; and a lock bar slidably mounted within the channel, the lock bar including a main body having a generally U-shape and a tab extending from the main body perpendicular from the false side wall, the tab received by the flange in order to guide the lock bar as it slides within the channel.

16. The cabinet of claim 15 wherein the flange of the channel forms a groove for receiving the tab of the lock bar.

17. The cabinet of claim 15 further comprising a slide that includes an integrally formed lock tab protruding from the drawer and received by an aperture of the lock bar in order to lock the drawer within the cabinet.

18. The cabinet of claim 17 wherein the slide includes a track for mounting to an attachment member of the false side wall.

* * * * *